US011524400B2

(12) United States Patent
Samsel et al.

(10) Patent No.: US 11,524,400 B2
(45) Date of Patent: Dec. 13, 2022

(54) WORK SITE STORAGE LOCK SYSTEM

(71) Applicant: APEX BRANDS, INC., Apex, NC (US)

(72) Inventors: Richard A. Samsel, Haines City, FL (US); Matthew Poppe, Holly Springs, NC (US); Andrew Speciale, Raleigh, NC (US)

(73) Assignee: Apex Brands, Inc., Apex, NC (US)

( * ) Notice: Subject to any disclaimer, the term of this patent is extended or adjusted under 35 U.S.C. 154(b) by 333 days.

(21) Appl. No.: 16/896,334

(22) Filed: Jun. 9, 2020

(65) Prior Publication Data

US 2020/0384633 A1 Dec. 10, 2020

Related U.S. Application Data

(60) Provisional application No. 62/859,385, filed on Jun. 10, 2019.

(51) Int. Cl.

| | |
|---|---|
| ***B25H 3/02*** | (2006.01) |
| ***E05B 65/46*** | (2017.01) |
| ***E05B 17/20*** | (2006.01) |
| ***E05C 1/10*** | (2006.01) |

(52) U.S. Cl.

CPC ..... *B25H 3/028* (2013.01); *E05B 65/46* (2013.01); *E05B 17/2007* (2013.01); *E05C 1/10* (2013.01); *E05Y 2900/208* (2013.01); *Y10T 292/0995* (2015.04)

(58) Field of Classification Search

CPC ..... B25H 3/028; B25H 3/02; E05B 65/46; E05B 17/2007; E05B 65/0003; E05B 65/52; E05C 1/10; E05Y 2900/208; Y10T 292/0969; Y10T 292/0977; Y10T 292/0995

See application file for complete search history.

(56) References Cited

U.S. PATENT DOCUMENTS 1,459,324 A * 6/1923 Diebold ..... E05B 65/462 312/334.47
1,712,842 A * 5/1929 Richardson ..... E05B 65/0003 312/297
1,984,345 A * 12/1934 Kennedy ..... B25H 3/028 220/515
2,286,427 A * 6/1942 Levensten ..... B25H 3/02 312/902
2,671,709 A * 3/1954 Radzyner ..... B25H 3/02 312/274
3,316,045 A * 4/1967 Leland ..... E05B 65/462 312/220

(Continued)

*Primary Examiner* — Hanh V Tran
(74) *Attorney, Agent, or Firm* — Burr & Forman LLP

(57) ABSTRACT

A tool chest may include a base portion, two opposing sidewalls, a drawer portion and a lid. The sidewalls extend substantially parallel to each other on opposite sides of the base portion to define a tool repository between the sidewalls. The lid has a closed position covering a top of the tool chest, and an open position in which access is provided to the tool repository. The drawer portion is slidable to at least partially remove the drawer portion from the base portion. The drawer portion is automatically locked by closing the lid via a locking assembly that is operable configured to automatically unlock with the lid is open unless the locking assembly is retained in a locked position.

18 Claims, 13 Drawing Sheets

(56) References Cited

U.S. PATENT DOCUMENTS 4,288,134 A * 9/1981 Knaack ..... A47B 81/00 70/56
4,775,199 A * 10/1988 Lanius ..... E05B 65/52 312/220
5,482,162 A * 1/1996 Dickinson ..... B25H 3/02 206/373
5,720,535 A * 2/1998 Mehman ..... E05B 65/462 312/265.2
6,375,235 B1 * 4/2002 Mehmen ..... E05C 3/14 292/128
6,681,604 B1 * 1/2004 Samsel ..... E05B 65/025 312/219
8,342,580 B2 * 1/2013 Cowie ..... B65D 43/22 292/148
11,085,206 B2 * 8/2021 Harrison ..... E05B 65/523
11,206,922 B2 * 12/2021 Hermann ..... A47B 46/00
2003/0178920 A1 * 9/2003 Ambriz ..... A47B 81/00 312/287
2006/0250055 A1 * 11/2006 Liu ..... B25H 3/028 312/218
2009/0284112 A1 * 11/2009 Mehmen ..... B25H 3/02 312/295
2014/0123478 A1 * 5/2014 Gylander ..... B25H 3/02 206/372
2014/0123715 A1 * 5/2014 Bergum ..... B25H 3/028 70/320
2014/0159385 A1 * 6/2014 Tuyen ..... E05B 53/005 292/157
2015/0061483 A1 * 3/2015 Liu ..... E05C 3/14 312/332.1
2015/0115786 A1 * 4/2015 Manalang ..... A47B 31/00 312/294
2015/0376917 A1 * 12/2015 Brunner ..... B25H 3/028 312/257.1
2016/0008972 A1 * 1/2016 Chen ..... B25H 3/023 206/373
2017/0190472 A1 * 7/2017 Milburn ..... B65D 25/2808
2018/0200876 A1 * 7/2018 Wolle ..... B25H 3/02
2018/0283053 A1 * 10/2018 McLean ..... B65D 25/22
2019/0242164 A1 * 8/2019 Richter ..... B25H 3/028

* cited by examiner

WORK SITE STORAGE LOCK SYSTEM

TECHNICAL FIELD

Example embodiments generally relate to containers for storing tools and, in particular, relate to a tool chest having an improved lock system.

BACKGROUND

Tool chests are familiar sights from worksites to garages. The tool chest allows tools to be stored in an organized way, but also typically provides the ability to store the tools in a secure manner. Given the cost, mobility and utility of hand tools and power tools, the ability to securely store the tools can be very important. This is particularly true at worksites where tools may need to remain for a period of time.

BRIEF SUMMARY OF SOME EXAMPLES

Some example embodiments may enable the provision of a tool chest that provides a locking assembly for automatic internal locking of the drawer portion of the tool chest when the lid of the tool chest is closed. The locking assembly is biased to be unlocked when the lid is open, but can be manually locked to remain locked even when the lid is open.

In an example embodiment, a tool chest is provided. The tool chest may include a base portion, two opposing sidewalls, a drawer portion and a lid. The sidewalls extend substantially parallel to each other on opposite sides of the base portion to define a tool repository between the sidewalls. The lid has a closed position covering a top of the tool chest, and an open position in which access is provided to the tool repository. The drawer portion is slidable to at least partially remove the drawer portion from the base portion. The drawer portion is automatically locked by closing the lid via a locking assembly that is operable configured to automatically unlock with the lid is open unless the locking assembly is retained in a locked position.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

DETAILED DESCRIPTION

Figure 1:
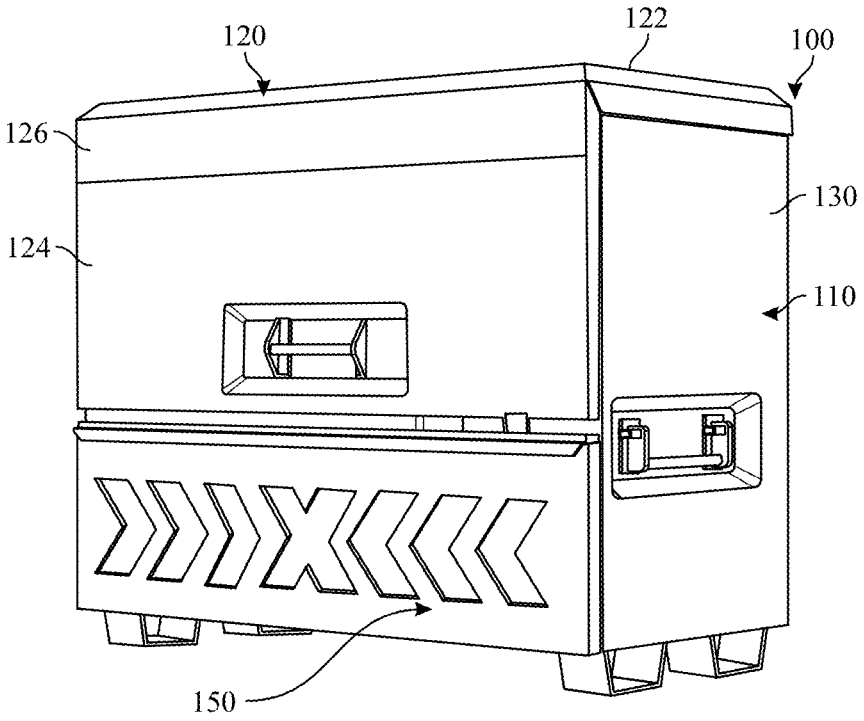
FIG. 1 illustrates a front perspective view of a tool chest with lid closed according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

As indicated above, some example embodiments may relate to the provision of a tool chest that provides a locking assembly for automatic internal locking of the drawer portion of the tool chest when the lid of the tool chest is closed. The locking assembly is biased to be unlocked when the lid is open, but can be manually locked to remain locked even when the lid is open. One particular example will be shown to illustrate the general designs for implementation of the locking assembly. However, it will be appreciated that example embodiments are not necessarily limited to the specific example disclosed. In this regard, although FIGS. 1-22 correspond to a first example embodiment having a lid that fold both upward and inward (i.e., a piano box), it should be appreciated that the same locking assembly could be used with other lids as well (e.g., for a tool chest with one rigid lid). Thus, for example, even a chest-type box that has a single flat and rigid lid, but also includes a drawer may employ example embodiments.

Referring now to FIGS. 1-22 a tool chest 100 according to the first example embodiment is provided having a base portion 110, a lid 120, a first sidewall 130, a second sidewall 140, and a drawer portion 150. The lid 120 may be operably coupled to a back panel of the tool chest 100 (e.g., extending between the first and second sidewalls 130 and 140) via a hinge assembly disposed at the intersection of the back panel and the lid 120. In some cases, the lid 120 may include top section 122 and a front section 124. The top section 122 and front section 124 may be operably coupled to each other by another hinge assembly such that, when the lid is opened, the top section 122 rotates about 90 degrees from a horizontal position to a nearly vertical position (in some cases just slightly past vertical) while the front section 124 pivots relative to the top section 122 so that the front section 124 can essentially remain oriented vertically.

Figure 2:
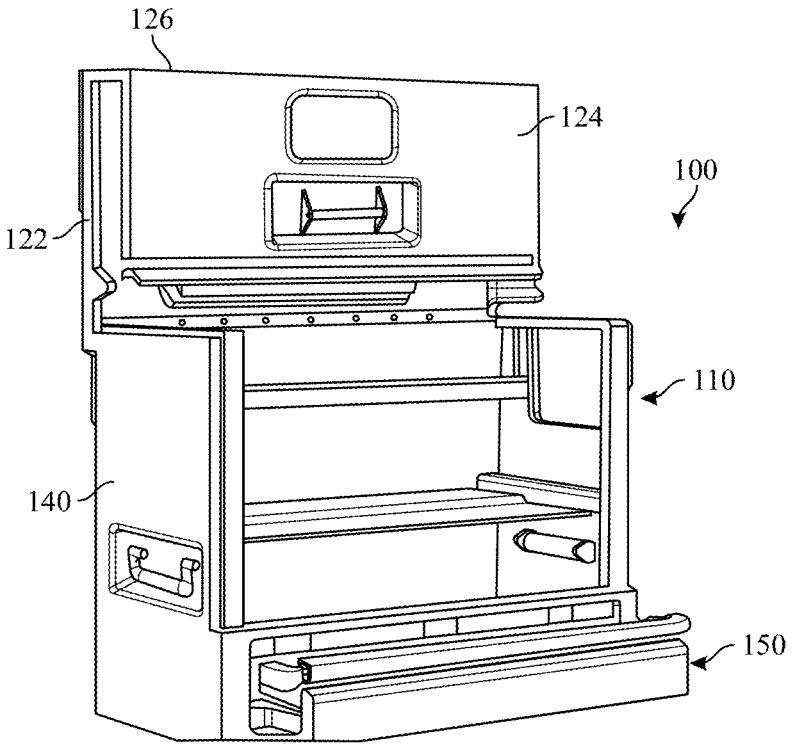
FIG. 2 illustrates a front perspective view of the tool chest with the lid open according to an example embodiment.

The top section 122 may include an overhang portion 126 that extends at about a 90 degree angle with respect to the rest of the top section 122. The overhang portion 126 therefore extends in-line with the front section 124 (i.e., vertically) when the lid 120 is closed (as shown in FIG. 1) and extends substantially perpendicular to the front section (124) and substantially horizontally when the lid 120 is open (as shown in FIG. 2).

Figure 3:
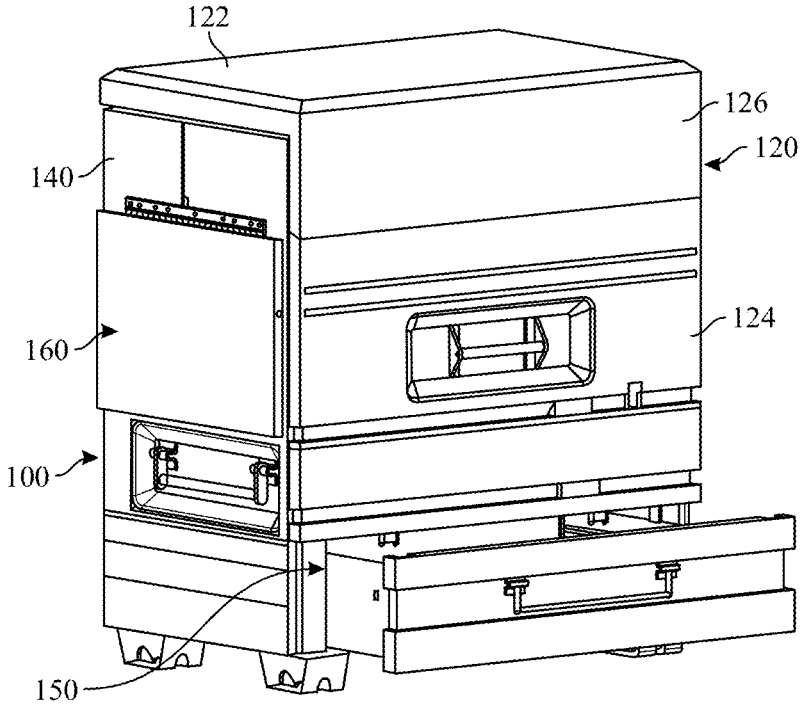
FIG. 3 is a front perspective view of the tool chest with the lid closed, and drawer open according to an example embodiment.
Figure 4:
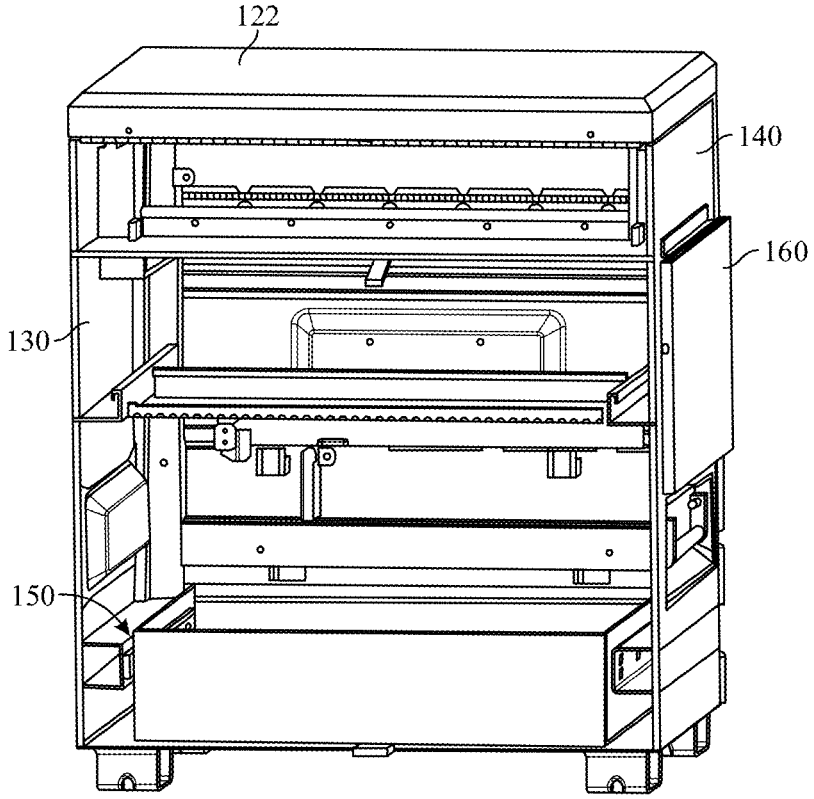
FIG. 4 illustrates a rear perspective view of the tool chest with the a back portion of the tool chest removed to expose some internal components on the front portion of the tool chest according to an example embodiment.

The drawer portion 150 can be embodied in different ways. FIG. 2 illustrates one embodiment of the drawer portion 150, and FIG. 3 illustrates a second embodiment for the drawer portion 150. The example of FIG. 3 also illustrates a folding work table 160 that may be attached to one of the sidewalls such as the second sidewall 140 in this example.

Figure 5:
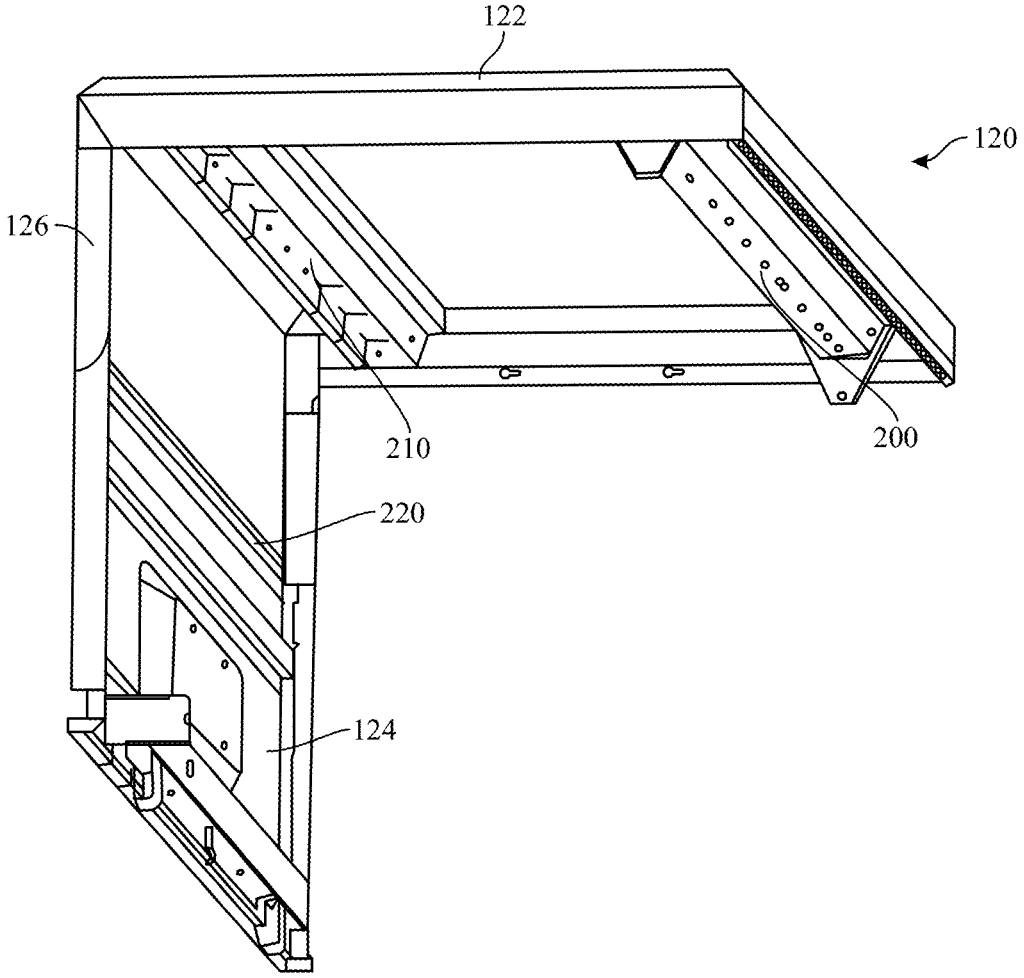
FIG. 5 illustrates an isolated perspective view of an internal portion of the lid in its closed position according to an example embodiment.
Figure 6:
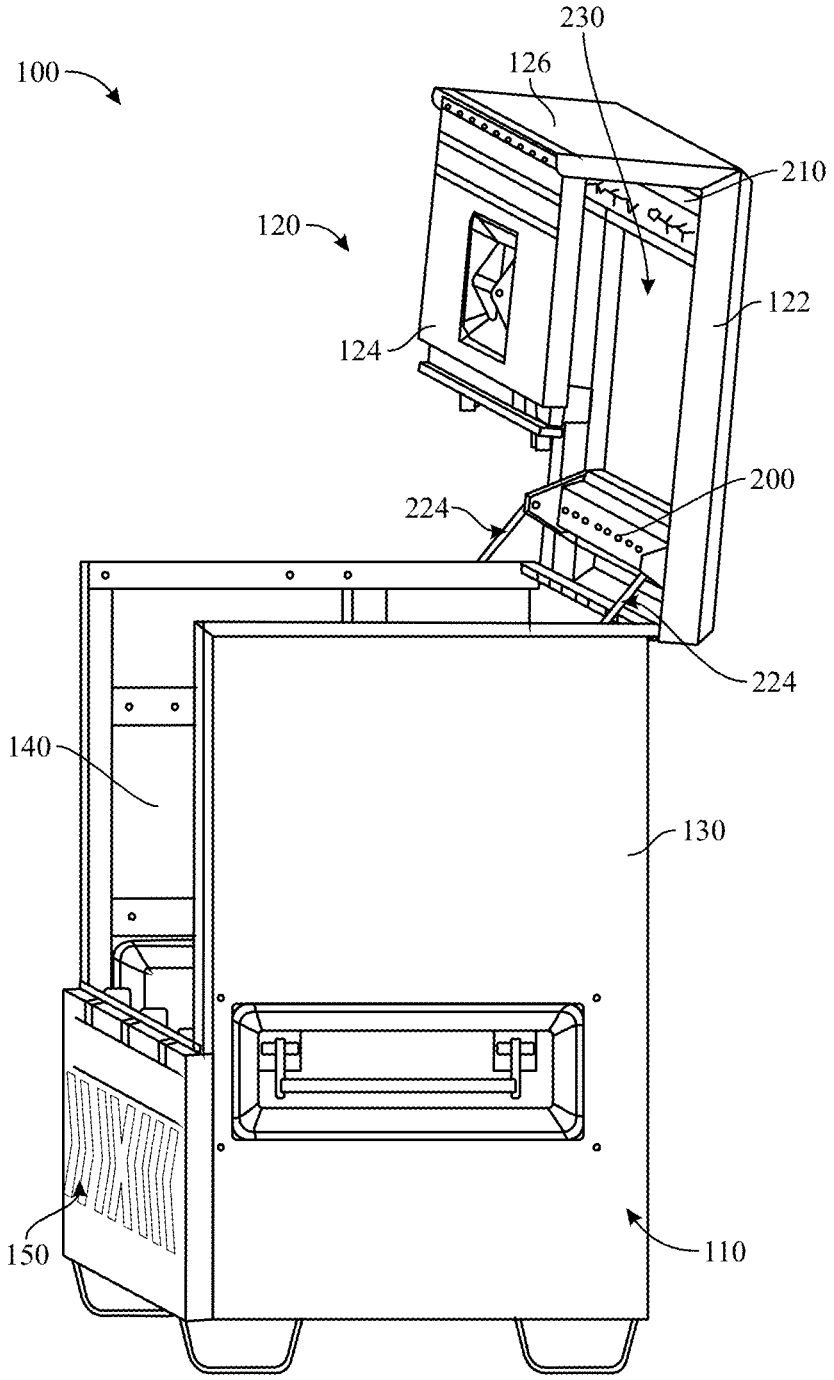
FIG. 6 illustrates a side perspective view of the tool chest with the lid open to illustrate a storage space created by opening the lid according to an example embodiment.

FIG. 5 illustrates an isolated perspective view of an internal portion of the lid 120 in the closed position according to an example embodiment. As shown in FIG. 5, the top section 122 of the lid 120 may include structural supports (i.e., bolsters) that are configured to extend laterally across the top section 122. At a rear portion of the lid 120 (i.e., proximate to the hinge assembly and the back panel) a hinge bolster 200 may be provided to extend across the top section 122. Meanwhile, at the front portion of the lid 120), a hanger support bolster 210 may be provided to extend across the top section 122 parallel to the hinge bolster 200. As can be appreciated from FIG. 5, when the lid 120 is closed, the hanger support bolster 210 and the hinge bolster 200 may each lie (or extend downward out of) a same, horizontal plane. Meanwhile, both the overhang portion 126 and the front section 124 extend downwardly from the top section 122 in a vertical plane. FIG. 5 also shows the hinge assembly 220 that operably couples the front section 124 to the overhang portion 126.

Figure 7:
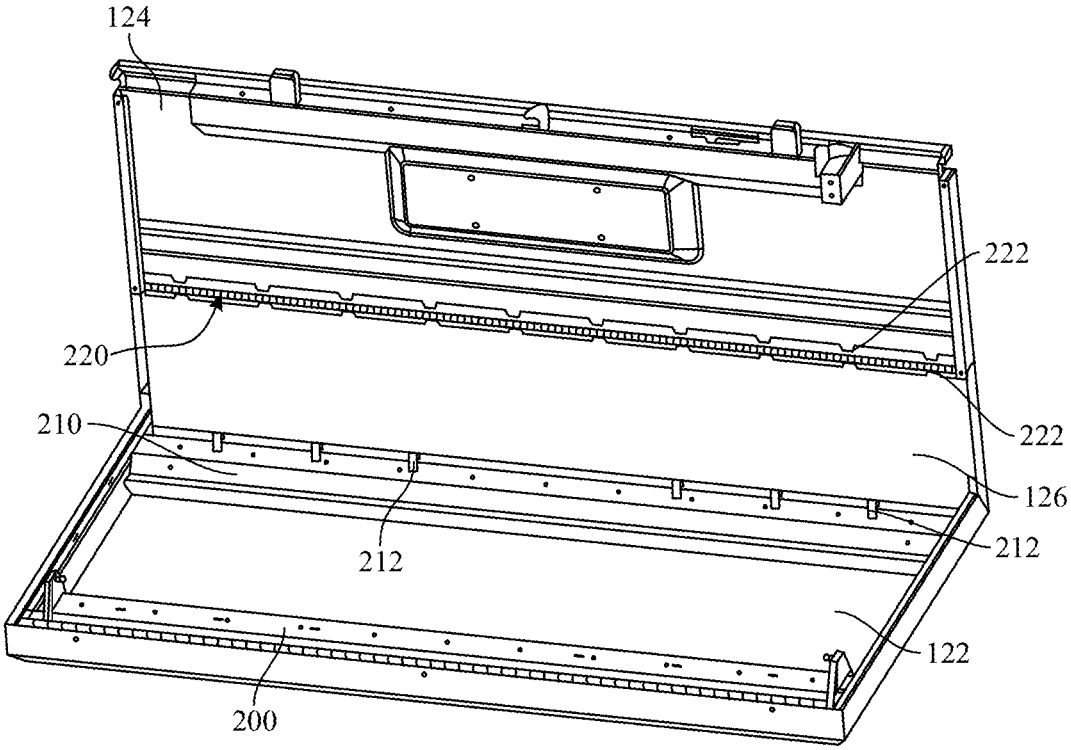
FIG. 7 illustrates another isolated perspective view of the inside of the lid according to an example embodiment.
Figure 12:
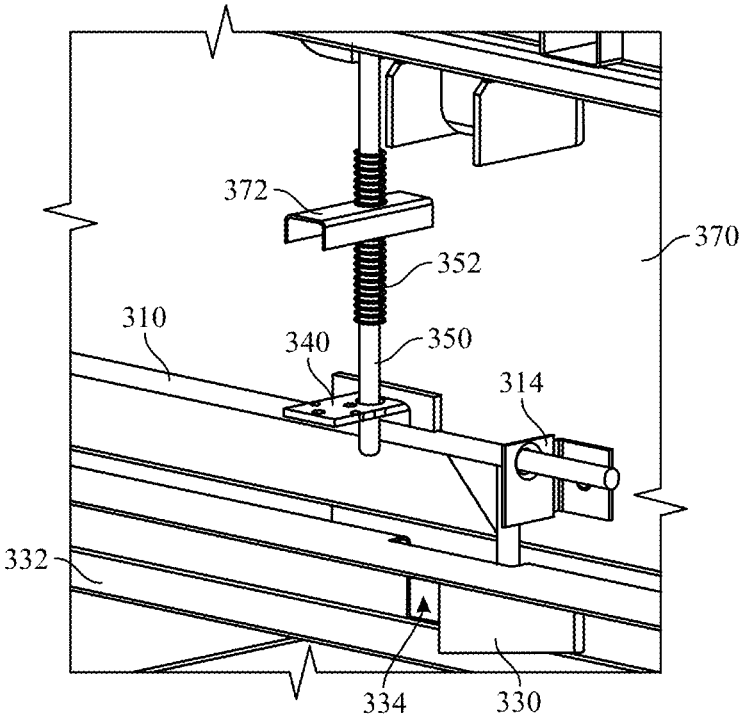
FIG. 12 is a detailed view of the locking assembly in the locked position according to an example embodiment.

As shown in FIGS. 7 and 12, the hinge assembly 220 may be notched hinge having a plurality of notches 222 disposed along its length. The operation of the hinge assembly 220 may be facilitated by one or more gas shocks 224 that may be operably coupled between the hinge bolster 200 (i.e., at respective opposite ends thereof) and respective top portions of the first and second sidewalls 130 and 140, respectively.

In an example embodiment, a locking assembly 300 may be disposed at a bottom portion of the front section 124, or otherwise at a location that enables interaction with the drawer portion 150 responsive to moving of the lid 120 to the closed position. In this regard, the locking assembly 300 may be internally locked by the interactions caused during closing of the lid 120. FIGS. 8-22 illustrate various portions of the locking assembly 300 that may be structured to perform this function.

Figure 8:
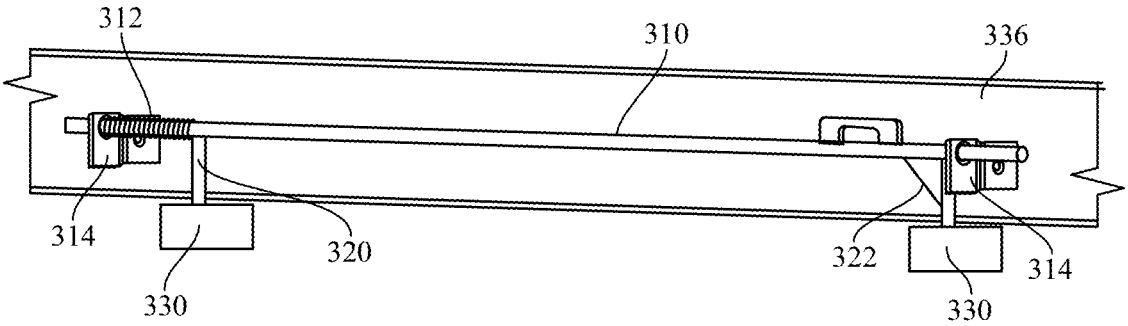
FIG. 8 illustrates portions of a locking assembly of the tool chest according to an example embodiment.

In this regard, FIG. 8 illustrates a latch pin 310 that is biased in a locked position by a spring 312. The latch pin 310 is slidably retained by brackets 314 to extend horizontally between the brackets 314. The latch pin 310 carries a first locking bar 320 and a second locking bar 322 spaced apart from respective opposing ends of the latch pin 310. The latch pin 310 may be operably coupled to a slide handle 324 disposed on a front of the tool chest 100 on the drawer portion 150. The slide handle 324 may be slid (when not locked) horizontally to move the position of the latch pin 310. In this regard, the slide handle 324 may be held (by the spring 312) such that the latch pin 310 is in the locked position, but may be slid to overcome the spring 312 force and horizontally reposition the latch pin 310 to an unlocked position.

Figure 9:
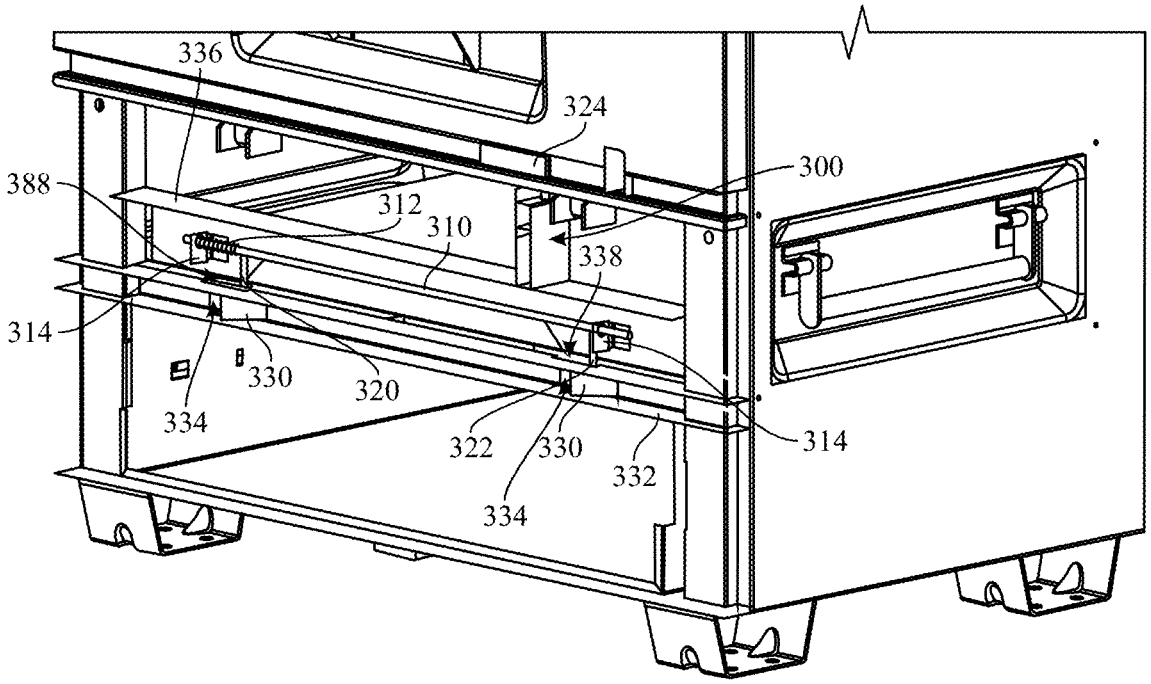
FIG. 9 illustrates a partially cutaway front view of the tool chest with the locking assembly in the locked position and further showing a slide handle for unlocking the locking assembly according to an example embodiment.
Figure 10:
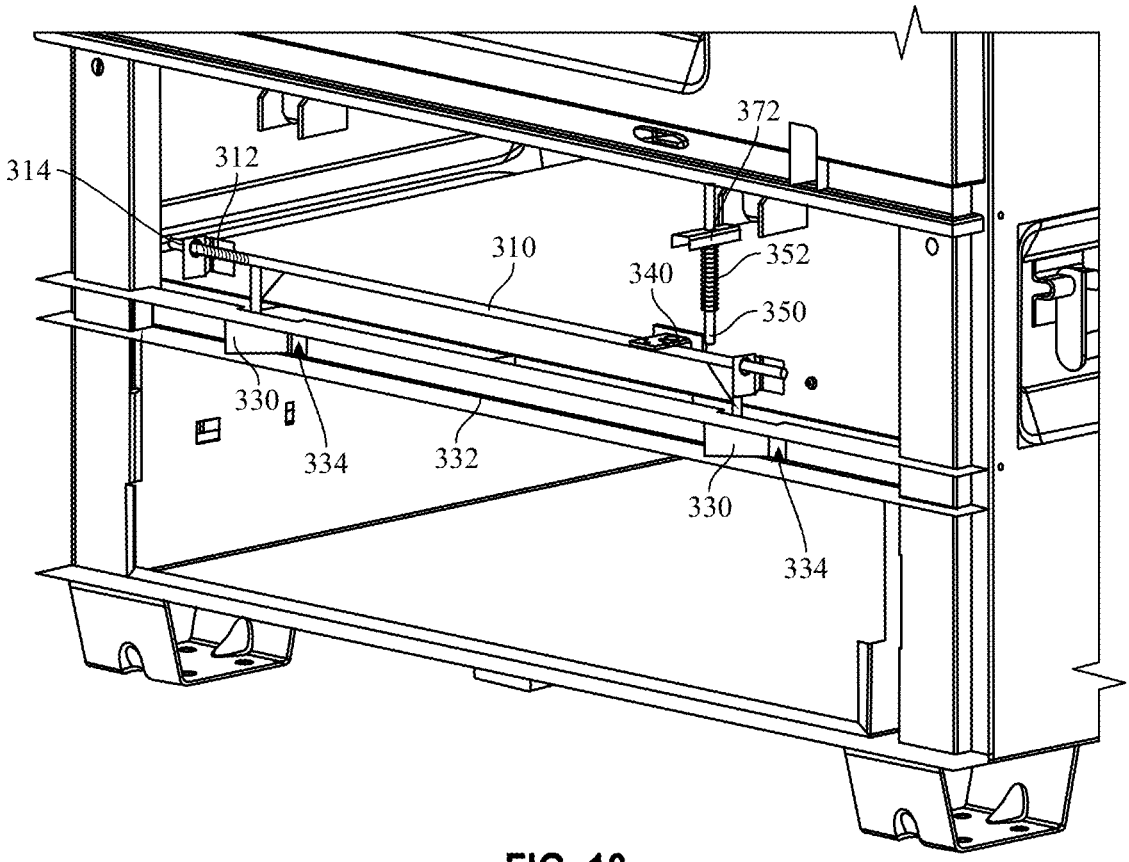
FIG. 10 illustrates a partially cutaway front view of the tool chest showing components of the locking assembly in the unlocked position according to an example embodiment.
Figure 11:
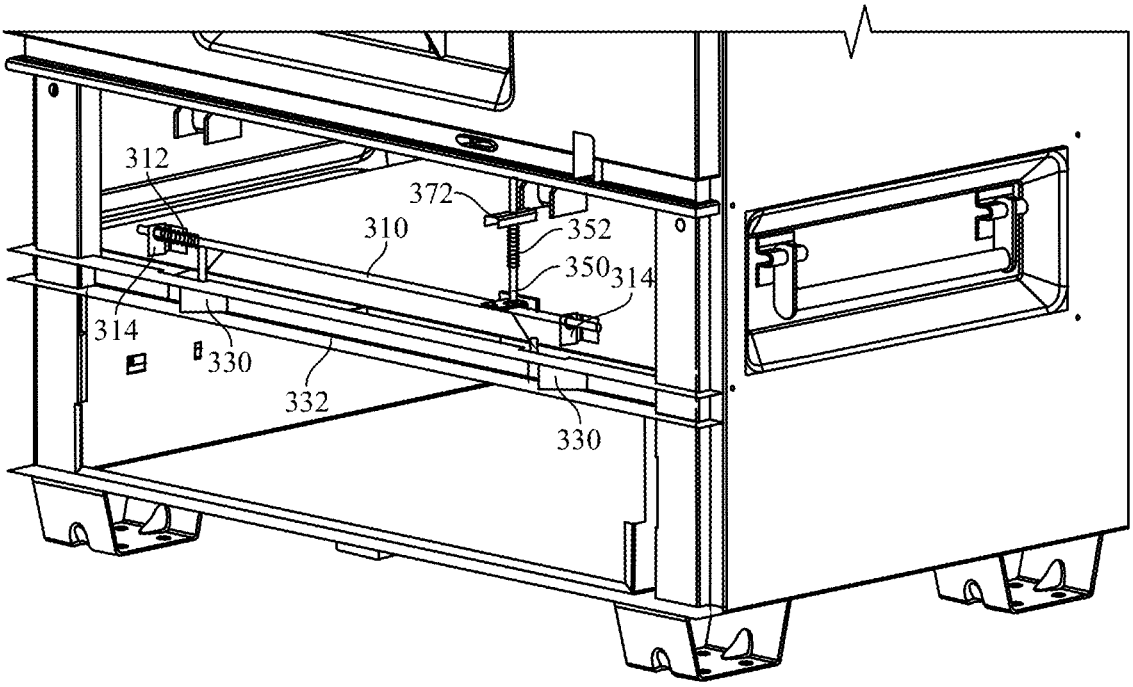
FIG. 11 illustrates a partially cutaway front view of the tool chest with the locking assembly in the locked position according to an example embodiment.

The first and second locking bars 320 and 322 may each extend downward to angle brackets 330. The angle brackets 330 may be configured be slidable within a lock bolster 332 that may extend laterally across the front of the drawer portion 150. The lock bolster 332 may include locking slots 334 that either align with the angle brackets 330 (i.e., in the unlocked position) or do not align with the angle brackets 330 (i.e., in the locked position). Meanwhile, the latch pin 310 may move within a locking gusset 336, and the first and second locking bars 320 and 322 may pass through respective slots 338 located in the locking gusset 336 in order to reach the angle brackets 330. Thus, for example, when the latch pin 310 is in the locked position (as shown in FIGS. 9 and 11), the angle brackets 330 are not aligned with the locking slots 334 and the locking slots 334 prevent withdrawal of the drawer portion 150. However, if the latch pin 310 can be moved by the sliding of the slide handle 324 to overcome the spring 213 force and move the latch pin 310 in a direction toward the spring 312 (e.g., to the left in FIGS. 8 and 9), then the locking slots 334 will align with the angle brackets 330 and the drawer portion 150 can be withdrawn. Such alignment is shown in FIG. 10, where the latch pin 310 is shown in the unlocked position.

Figure 13:
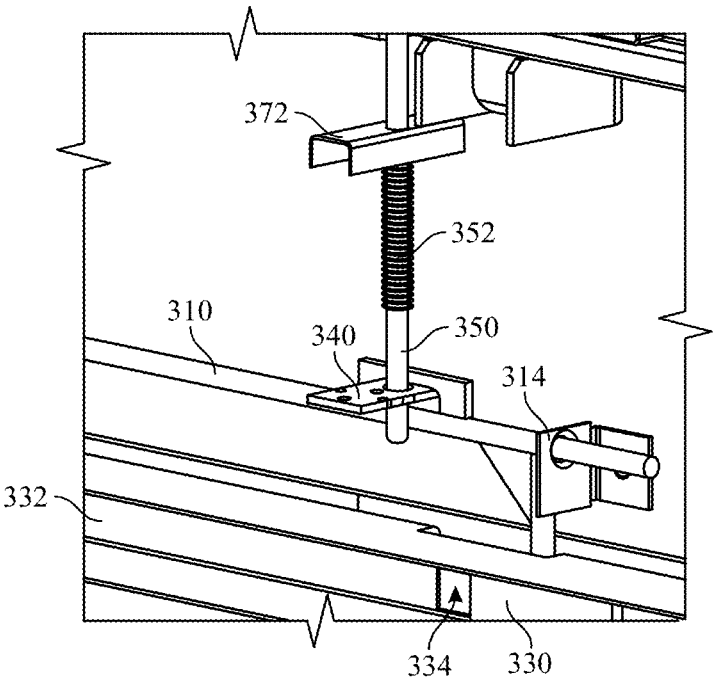
FIG. 13 is a detailed view of the locking assembly in the unlocked position according to an example embodiment.
Figure 14:
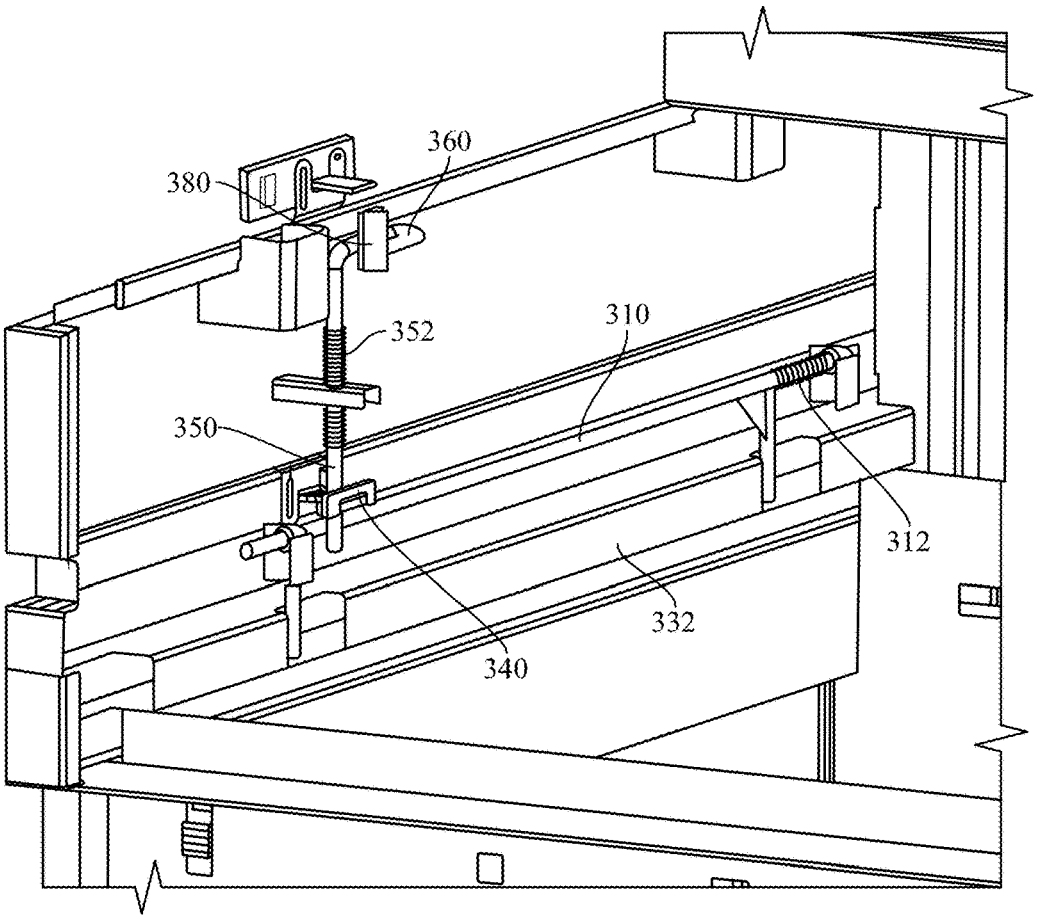
FIG. 14 is a partially cut-away perspective view of a lock lever of the locking assembly in the locked position according to an example embodiment.
Figure 15:
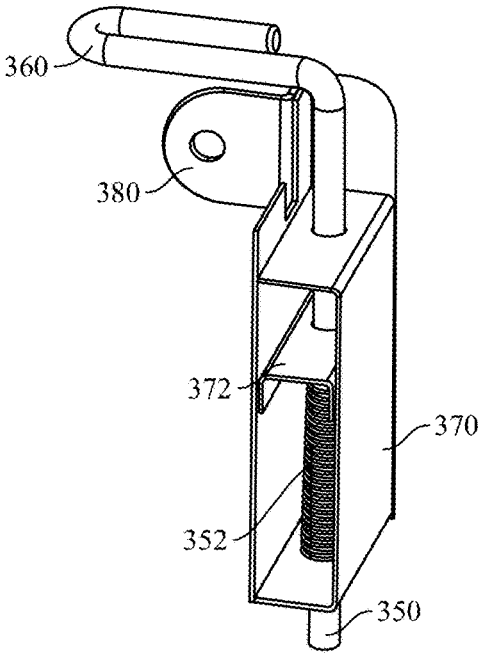
FIG. 15 is an isolated perspective view of a lock lever of the locking assembly in the unlocked position according to an example embodiment.
Figure 16:
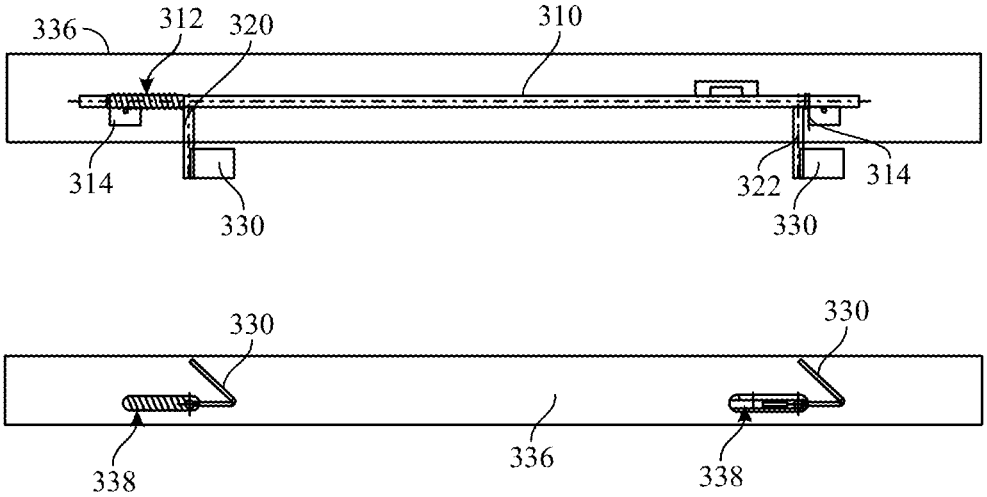
FIG. 16 illustrates portions of the locking assembly according to an example embodiment.
Figure 17:
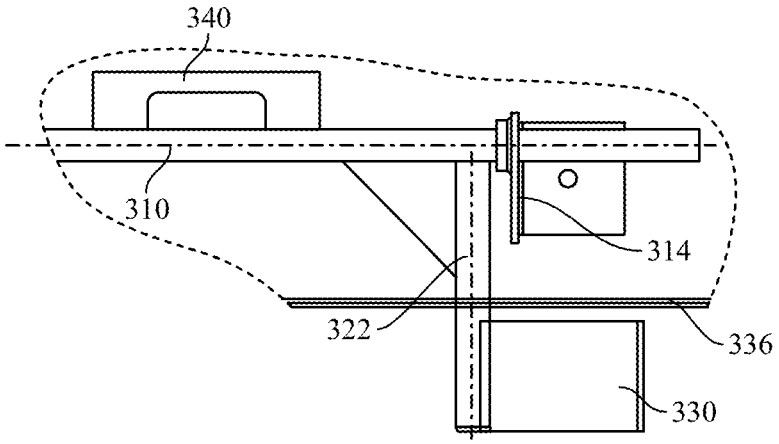
FIG. 17 is a detail view of portions of the locking assembly shown in FIG. 16 according to an example embodiment.
Figure 18:
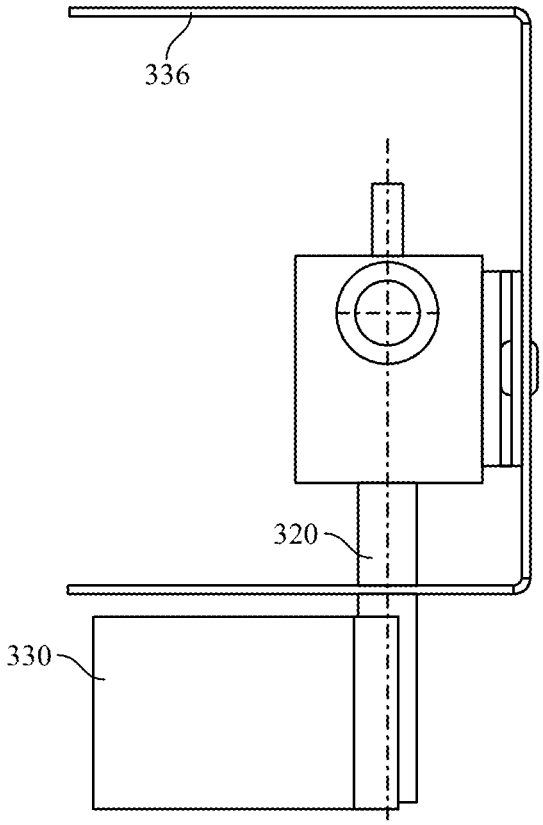
FIG. 18 is another detail view of portions of the locking assembly according to an example embodiment.
Figure 19:
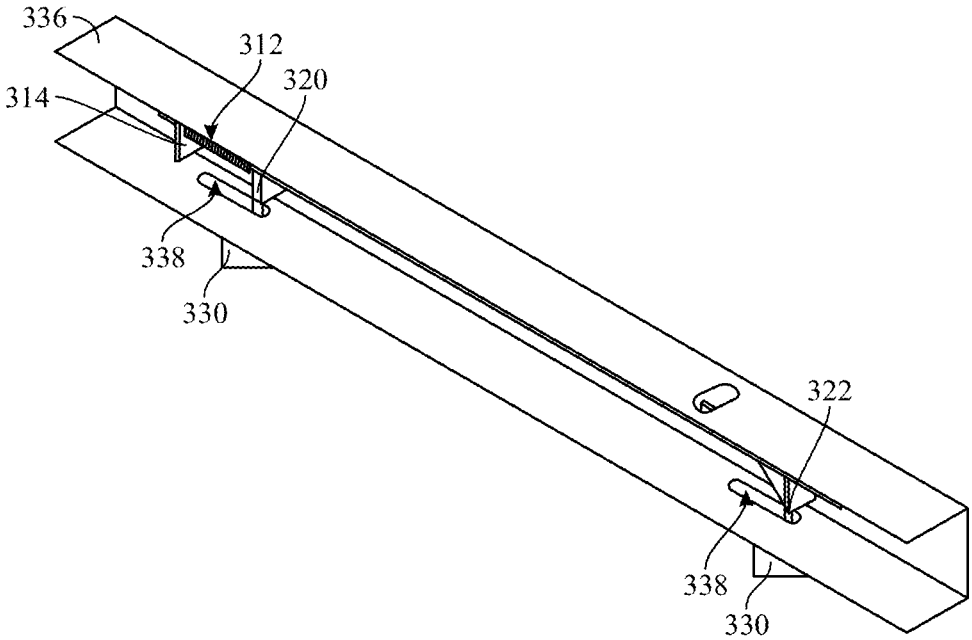
FIG. 19 is a perspective view of a portion of the locking assembly according to an example embodiment.
Figure 20:
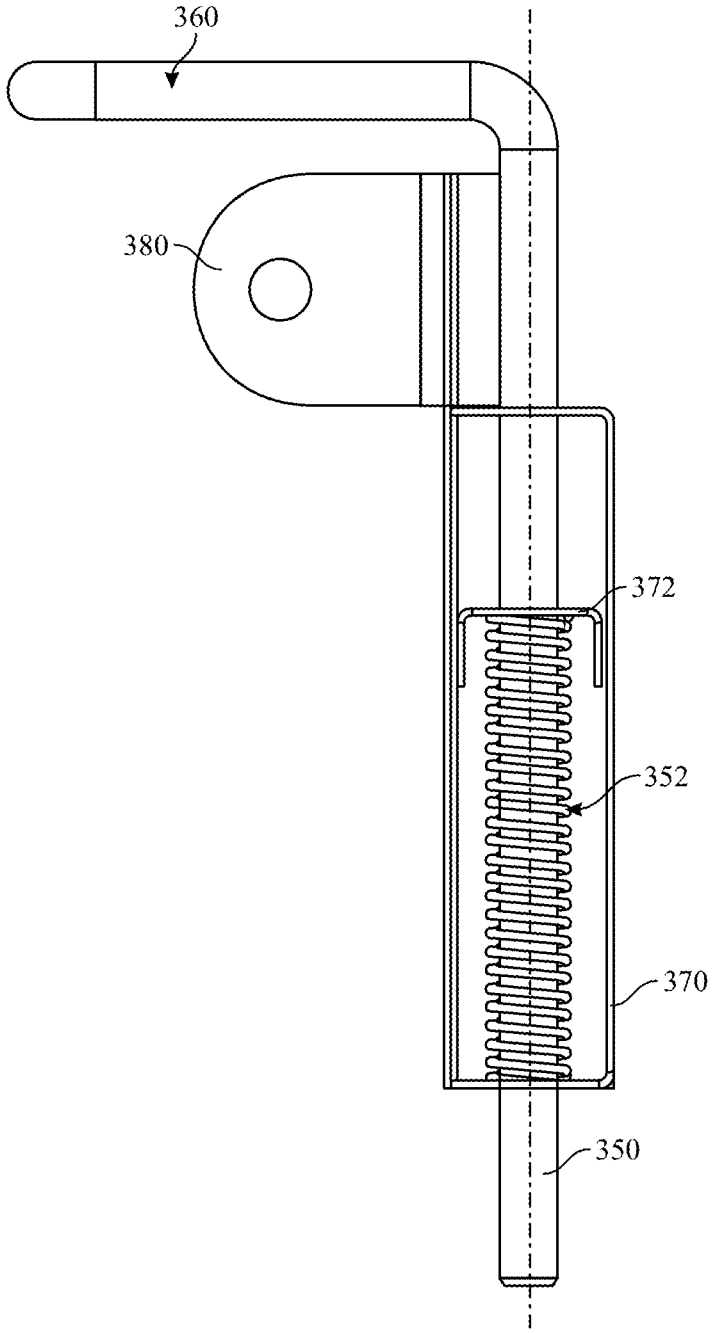
FIG. 20 is an isolated side view of the lock lever of the locking assembly in the unlocked position according to an example embodiment.
Figure 21:
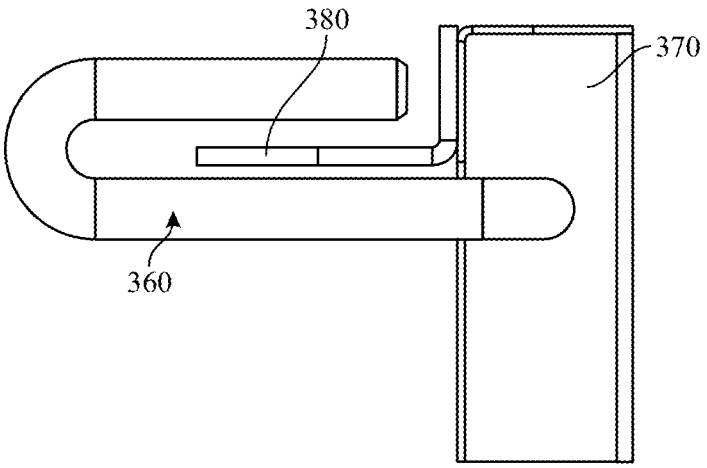
FIG. 21 is an isolated top view of the lock lever of the locking assembly in the unlocked position according to an example embodiment.
Figure 22:
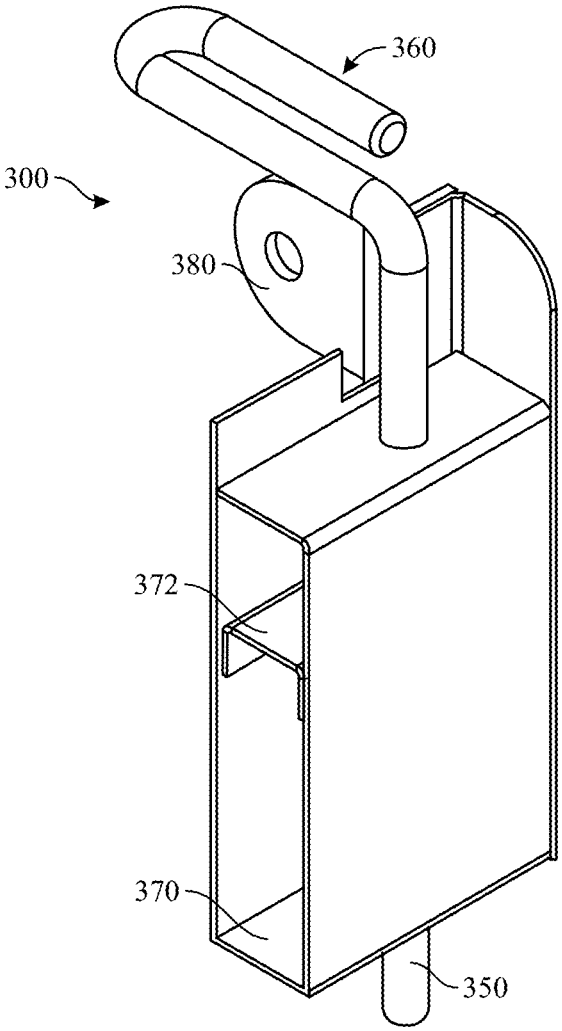
FIG. 22 is an isolated perspective view of the lock lever of the locking assembly in the unlocked position according to an example embodiment.

All that being said, the movement of the slide 324 may be prevented in some cases by automatic or manual locking thereof by the locking assembly 300. In this regard, latch pin 310 may also carry a catch bracket 340. The catch bracket 340 may move laterally with movement of the latch pin 310 and, when the latch pin 310 is in the locked position to which the spring 312 normally biases the latch pin 310, the catch bracket 340 may have an opening therein which aligns with a lock pin 350 of the locking assembly 300 as shown in FIGS. 11-13. However, when the slide handle 324 is moved to overcome the spring 312 and slide the latch pin 310 into the unlocked position (as shown in FIG. 10), the latch pin 310 is not aligned with the opening in the catch bracket 340.

Alignment of the lock pin 350 with the opening of the catch bracket 340 enables the lock pin 350 to be driven down through the opening in the catch bracket 340 to prevent movement of the slide handle 324 and the latch pin 310. In this regard, FIGS. 11 and 13 clearly show the lock pin 350 aligned with the opening of the catch bracket 340, whereas FIG. 12 shows the lock pin 350 driven through the opening in the catch bracket 340 and therefore in the locked position.

As can be seen in FIGS. 11-15 and 20, the lock pin 350 carries a spring 352 that is used to bias the lock pin 350 in an unloaded position (i.e., as shown in FIGS. 11 and 13). Thus, the biasing of the spring 352 is such that the lock pin 350 is generally biased upward so that the lock pin 350 is not driven through the opening in the catch bracket 340. Overcoming the biasing of the spring 352 on the lock pin 350 is required in order to drive the lock pin 350 through the opening in the catch bracket 340 and load the spring 352 (i.e., so that it is biased to push the lock pin 350 back out of the opening in the catch bracket 340). Meanwhile, as noted above, the locking assembly 300 is normally unlocked and automatically locked with the lid 120 is closed. Thus, as can be appreciated from the descriptions above, the locking assembly 300 is shifted (by virtue of closing the lid 120) from the unlocked position to the locked position. Therefore, it can be appreciated that the closing of the lid 120 overcomes the force of the spring 352 to drive the lock pin 350 through the opening in the catch bracket 340 to lock the locking assembly 300 and retain the latch pin 310 is a position where the angle brackets 330 are not aligned with the locking slots 334 in the lock bolster 332. However, when the lid 120 is opened, the locking assembly 300 may automatically (unless prevented from doing so) shift back to the unlocked position to allow the slide handle 324 to be moved and the drawer portion 150 to be opened. Structures associated with this automatic locking (and unlocking) and unlocking of the locking assembly 300 will now be described in reference to FIGS. 14, 15 and 20-22.

In this regard, the locking assembly 300 includes a locking lever 360 that is operably coupled to a top portion of the lock pin 350. The locking lever 360 of this example is a U-shaped bar that extends substantially perpendicularly away from the top portion of the lock pin 350. The locking lever 360 extends above a retaining bracket 370. The spring 352 that is carried on the lock pin 350 is disposed between a biasing bracket 372 that is carried on the lock pin 350 at a fixed portion thereof and a bottom portion of the retaining bracket 370. Thus, when the lid 120 is in the closed position, the lid 120 (or a portion thereof or extension therefrom) will push down on the locking lever 360 thereby moving the locking pin 350 downward. Movement of the lock pin 350 downward will compress the spring 352 between the biasing bracket 372 and the bottom portion of the retaining bracket 370. However, movement of the lock pin 350 downward will also (if aligned) push the lock pin 350 through the opening in the catch bracket 340 to prevent lateral movement of the latch pin 330 as described above.

Thereafter, when the lid 120 is opened, the spring 352 may unload to push the lock pin 350 upward and out of the opening in the catch bracket 340. This will also position the locking lever 360 upward to its unlocked position to ready the locking lever 360 to be automatically moved to the locked position again when the lid 120 is re-closed. However, it is also possible to retain the locking lever 360 in the locked position (i.e., against the biasing of the spring 352). In this regard, a locking bracket 380 may be disposed proximate to the locking lever 360 to permit retention of the lock lever 360 in the locked position even when the lid 120 is opened. Specifically, when the locking lever 360 has been pushed downward to drive the lock pin 350 into the opening of the catch bracket 350, a lock (e.g., a pad lock or other locking device) can be passed through the locking bracket 380 and will hold the locking lever 360 in the locked position until both the lock is removed and the lid 120 is opened. As shown best in FIG. 14, the locking lever 360 is not accessible from outside the tool chest 100.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A tool chest comprising:

a base portion;

two opposing sidewalls extending substantially parallel to each other on opposite sides of the base portion to define a tool repository between the sidewalls;

a lid that has a closed position covering a top of the tool chest, and an open position in which access is provided to the tool repository; and a drawer portion that is slidable to at least partially remove the drawer portion from the base portion, wherein the drawer portion is automatically locked by moving the lid to the closed position via a locking assembly that is configured to automatically unlock when the lid is in the open position unless the locking assembly is retained in a locked state wherein the locking assembly comprises a latch pin configured to translate between a locked position defining the locked state of the locking assembly, and an unlocked position defining an unlocked state for the locking assembly, and wherein the latch pin is biased by a spring to the locked position.

2. The tool chest of claim 1, wherein the latch pin and the spring are oriented horizontally, and wherein the latch pin is disposed inside the drawer portion and is operably coupled to a slide handle disposed at an outside of the drawer portion and configured to slide horizontally to transition the locking assembly between the locked state and an unlocked state.

3. The tool chest of claim 2, wherein the latch pin is operably coupled to a locking bar to carry the locking bar horizontally responsive to movement of the slide handle, wherein the locking bar interfaces with a lock bolster to define the locked position and the unlocked position of the latch pin.

4. The tool chest of claim 3, wherein the lock bolster includes a locking slot configured to align with an angle bracket operably coupled to the locking bar in the unlocked position, and not align with the angle bracket in the locked position thereby preventing withdrawal of the drawer portion.

5. The tool chest of claim 2, wherein the latch pin carries a catch bracket that moves horizontally with the latch pin to facilitate automatically locking the drawer portion when the lid is in the closed position.

6. The tool chest of claim 5, wherein the catch bracket is aligned with a lock pin when the latch pin is in the locked position, and is not aligned with the lock pin when the latch pin is in the unlocked position.

7. The tool chest of claim 6, wherein the lock pin is oriented vertically above the catch bracket, and wherein closing the lid urges the lock pin downward such that, when aligned with the catch bracket, the lock pin is inserted into the catch bracket to prevent the latch pin from leaving the locked position.

8. The tool chest of claim 7, wherein the lock pin is biased against downward motion such that the lock pin is urged upward away from the catch bracket when the lid is in the open position.

9. The tool chest of claim 8, wherein the locking assembly comprises a locking lever operably coupled to the lock pin, wherein the locking lever is contacted by the lid to urge the lock pin downward when the lid is in the closed position.

10. The tool chest of claim 9, wherein the locking lever is configured to be retained against biasing of the lock pin to prevent the lock pin from downward movement into the catch bracket by being operably coupled to a locking bracket.

11. The tool chest of claim 1, wherein the locking assembly is configured to automatically lock the drawer portion when the lid is in the closed position unless the locking assembly is retained in an unlocked state.

12. A locking assembly for a tool chest that has a drawer portion and a lid that has a closed position preventing access to a tool repository of the tool chest, and an open position in which access is provided to the tool repository, the locking assembly comprising:

a latch pin configured to translate between a locked position defining a locked state of the locking assembly, and an unlocked position defining an unlocked state for the locking assembly, and a spring configured to bias the latch pin to the locked position, wherein the locking assembly is configured to automatically lock the drawer portion responsive to the lid being in the closed position and to automatically unlock when the lid is in the open position unless the locking assembly is retained in a locked state.

13. The locking assembly of claim 12, wherein the latch pin and the spring are oriented horizontally, and wherein the latch pin is disposed inside the drawer portion and is operably coupled to a slide handle disposed at an outside of the drawer portion and configured to slide horizontally to transition the locking assembly between the locked state and an unlocked state.

14. The locking assembly of claim 13, wherein the latch pin is operably coupled to a first locking bar and a second locking bar to carry the first and second locking bars horizontally responsive to movement of the slide handle, wherein the first and second locking bars interface with a lock bolster to define the locked position and the unlocked position of the latch pin.

15. The locking assembly of claim 14, wherein the lock bolster includes locking slots configured to align with angle brackets operably coupled to the first and second locking bars in the unlocked position, and not align with the angle brackets in the locked position thereby preventing withdrawal of the drawer portion.

16. The tool chest of claim 15, wherein the latch pin carries a catch bracket that moves horizontally with the latch pin to facilitate automatically locking the drawer portion when the lid is in the closed position.

17. The tool chest of claim 16, wherein the catch bracket is aligned with a lock pin when the latch pin is in the locked position, and is not aligned with the lock pin when the latch pin is in the unlocked position.

18. The tool chest of claim 17, wherein the lock pin is oriented vertically above the catch bracket, and wherein closing the lid urges the lock pin downward such that, when aligned with the catch bracket, the lock pin is inserted into the catch bracket to prevent the latch pin from leaving the locked position.

* * * * *